US005125751A

United States Patent [19]

Coigley

[11] Patent Number: 5,125,751

[45] Date of Patent: Jun. 30, 1992

[54] STIRRING DEVICE

[76] Inventor: Joseph H. Coigley, 34 Hawkes St., Saugus, Mass. 01906

[21] Appl. No.: 714,917

[22] Filed: Jun. 13, 1991

[51] Int. Cl.[5] ..... B01F 13/00

[52] U.S. Cl. ..... 366/129; 366/342; 68/17 R; 68/215

[58] Field of Search ..... D7/682; 366/342, 129, 366/343, 348, 349; 16/111 R, 114 R; 15/143 R, 141.1; 81/177.1, 177.6, 489, 492; 241/169.2; 68/17 R, 215, 122

[56] References Cited

U.S. PATENT DOCUMENTS 3,619,009 11/1971 O'Leary ..... 16/114 R
4,418,732 12/1983 Kolonia ..... 81/489

FOREIGN PATENT DOCUMENTS 0615930 3/1961 Canada ..... 15/143 R
0456049 4/1962 France ..... 68/215
0555793 9/1943 United Kingdom ..... 241/169.2

*Primary Examiner*—Harvey C. Hornsby
*Assistant Examiner*—Reginald L. Alexander
*Attorney, Agent, or Firm*—Leon Gilden

[57] ABSTRACT

An organization is provided with an elongate handle formed with a mounting cap at a forward end thereof, with a "Y" shaped support bracket mounted to the mounting cap mounted to a serpentine stirring member thereon, wherein the serpentine member is oriented orthogonally relative to an axis defined by the cylindrical mounting cap. The organization is utilized for the stirring of elastomeric garments and the like in a washing procedure. A modification of the invention includes an elongate flexible handle permitting agitation of the stirring member, with a selectively insertable stiffening rod to provide selective stiffening of the handle when desired. Further, the organization may include agitating tubes securable to the stirring member for enhanced agitation and dispensing of a soap mixture therefrom.

2 Claims, 4 Drawing Sheets

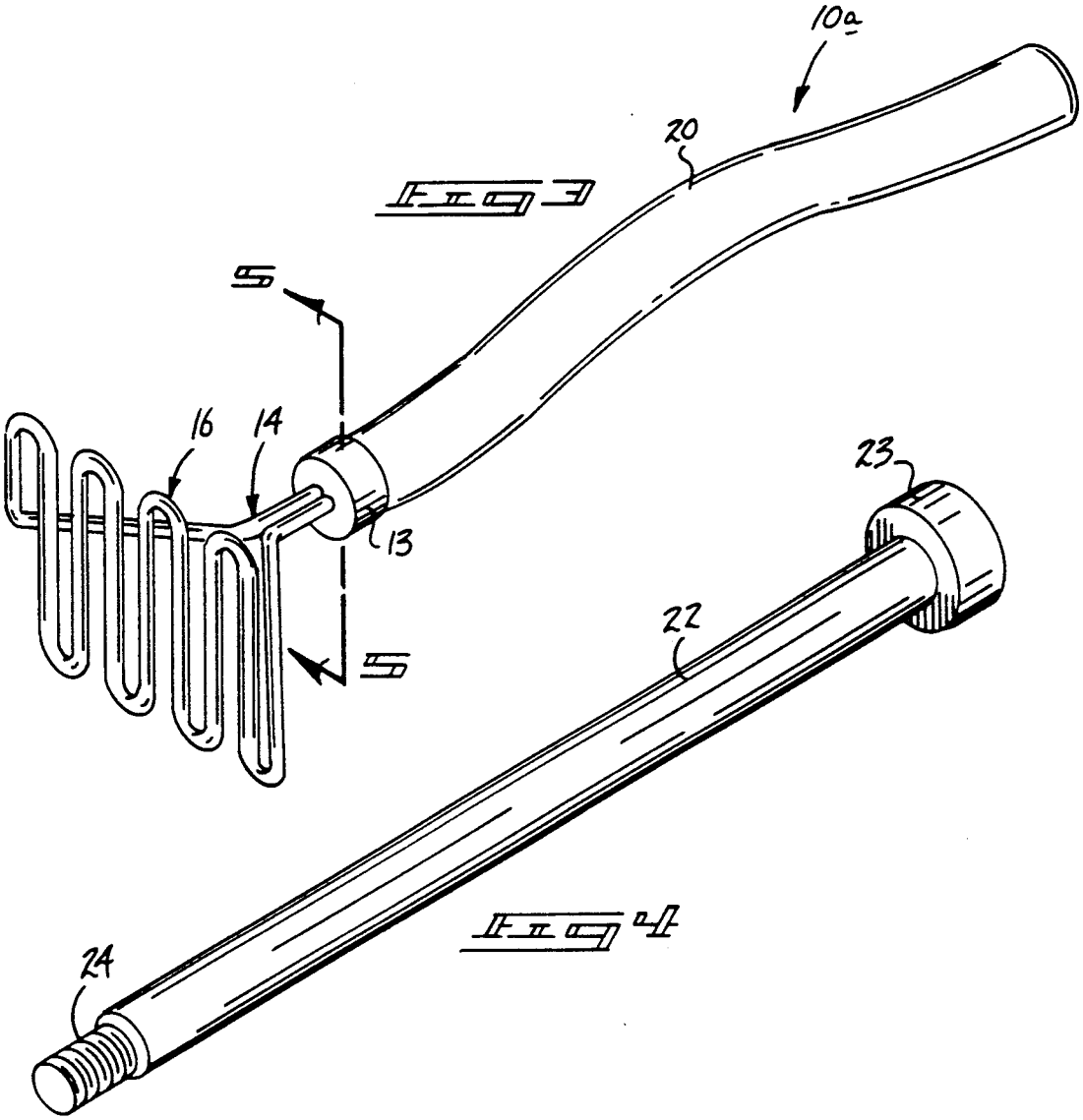
Fig 3
Fig 4
Fig 5
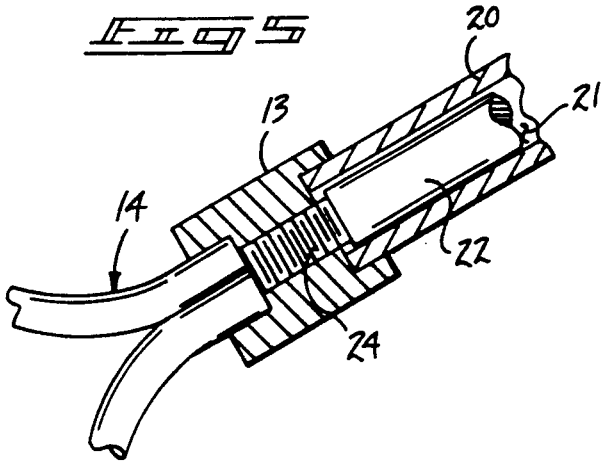

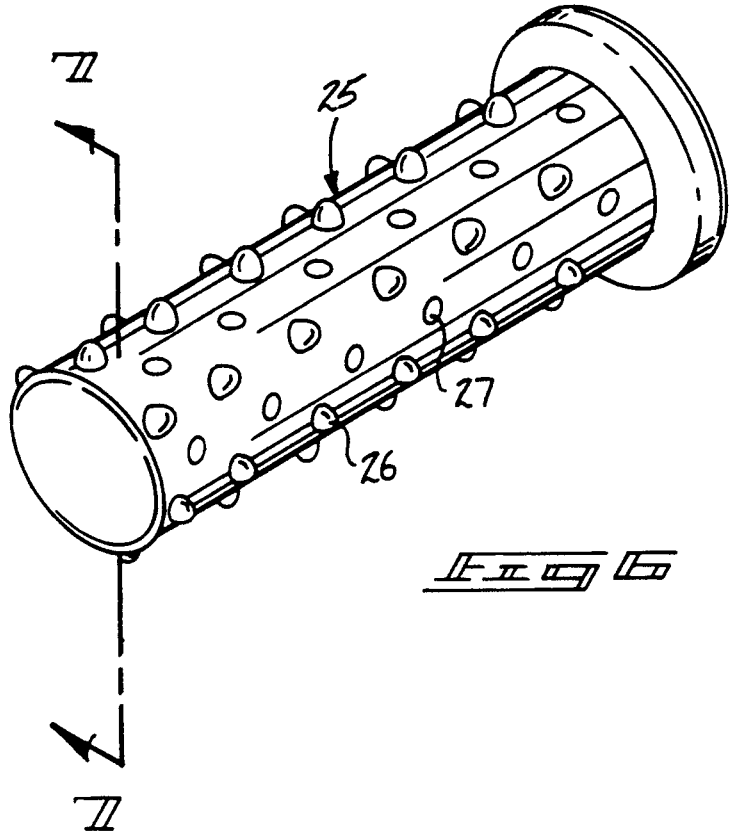
Fig 6
Fig 7
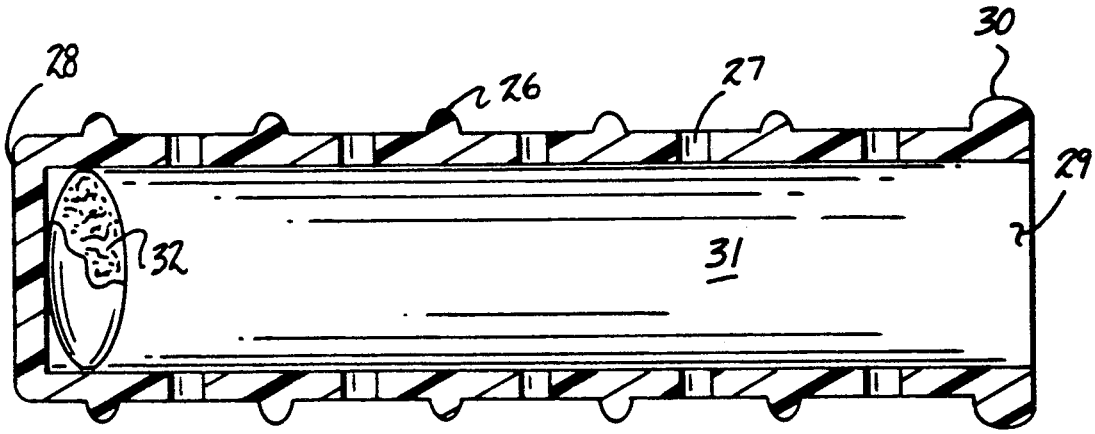

STIRRING DEVICE

BACKGROUND OF THE INVENTION

1. Field of the Invention

The field of invention relates to washing and stirring devices, and more particularly pertains to a new and improved stirring device wherein the same is utilized for the washing and stirring of garments.

2. Description of the Prior Art

In the cleaning of various elastomeric garments, such as support hose and the like, these garments are typically hand washed due to their fragile nature. The instant invention sets forth an organization to enhance manual manipulation of these garments within a soapy solution to effect their cleaning.

Various prior art devices are utilized to provide elongated portions to assist in various procedures such as typified in U.S. Pat. No. 4,091,805 to Clark wherein a back scratcher is provided with a vibratory means to assist in the scratching of various anatomical body portions of an individual.

U.S. Pat. No. 3,856,002 to Matsumoto sets forth a further example of a massaging device for massaging difficult to reach body portions.

U.S. Pat. No. 4,508,108 to Miyaoka sets forth an adjustable body brush and massager.

As such, it may be appreciated that there continues to be a need for a new and improved stirring device as set forth by the instant invention which addresses both the problems of ease of use as well as effectiveness in construction in effecting garment manipulation in a washing procedure and in this respect, the present invention substantially fulfills this need.

SUMMARY OF THE INVENTION

In view of the foregoing disadvantages inherent in the known types of stirring apparatus now present in the prior art, the present invention provides a stirring device wherein the same is arranged for enhanced ease of manipulation of garments in a washing procedure. As such, the general purpose of the present invention, which will be described subsequently in greater detail, is to provide a new and improved stirring device which has all the advantages of the prior art washing devices and none of the disadvantages.

To attain this, the present invention provides an organization with an elongate handle formed with a mounting cap at a forward end thereof, with a "Y" shaped support bracket mounted to the mounting cap mounted to a serpentine stirring member thereon, wherein the serpentine member is oriented orthogonally relative to an axis defined by the cylindrical mounting cap. The organization is utilized for the stirring of elastomeric garments and the like in a washing procedure. A modification of the invention includes an elongate flexible handle permitting agitation of the stirring member, with a selectively insertable stiffening rod to provide selective stiffening of the handle when desired. Further, the organization may include agitating tubes securable to the stiffing member for enhanced agitation and dispensing of a soap mixture therefrom.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stirring device which has all the advantages of the prior art washing devices and none of the disadvantages.

It is another object of the present invention to provide a new and improved stirring device which may be easily and efficiently manufactured and marketed.

It is a further object of the present invention to provide a new and improved stirring device which is of a durable and reliable construction.

An even further object of the present invention is to provide a new and improved stirring device which is susceptible of a low cost of manufacture with regard to both materials and labor, and which accordingly is then susceptible of low prices of sale to the consuming public, thereby making such stirring devices economically available to the buying public.

Still yet another object of the present invention is to provide a new and improved stirring device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of a modification of the invention.

FIG. 4 is an isometric illustration of a stiffening rod utilized by the device as set forth in FIG. 3.

FIG. 5 is an orthographic view, taken along the lines 5—5 of FIG. 3 illustrating the stiffening rod assembled within the handle, as illustrated in FIG. 3.

FIG. 6 is an isometric illustration of an agitating tube utilized in conjunction with the modification of the invention.

FIG. 7 is an orthographic view, taken along the lines 7—7 of FIG. 6 in the direction indicated by the arrows.

DESCRIPTION OF THE PREFERRED EMBODIMENT

Figure 1:
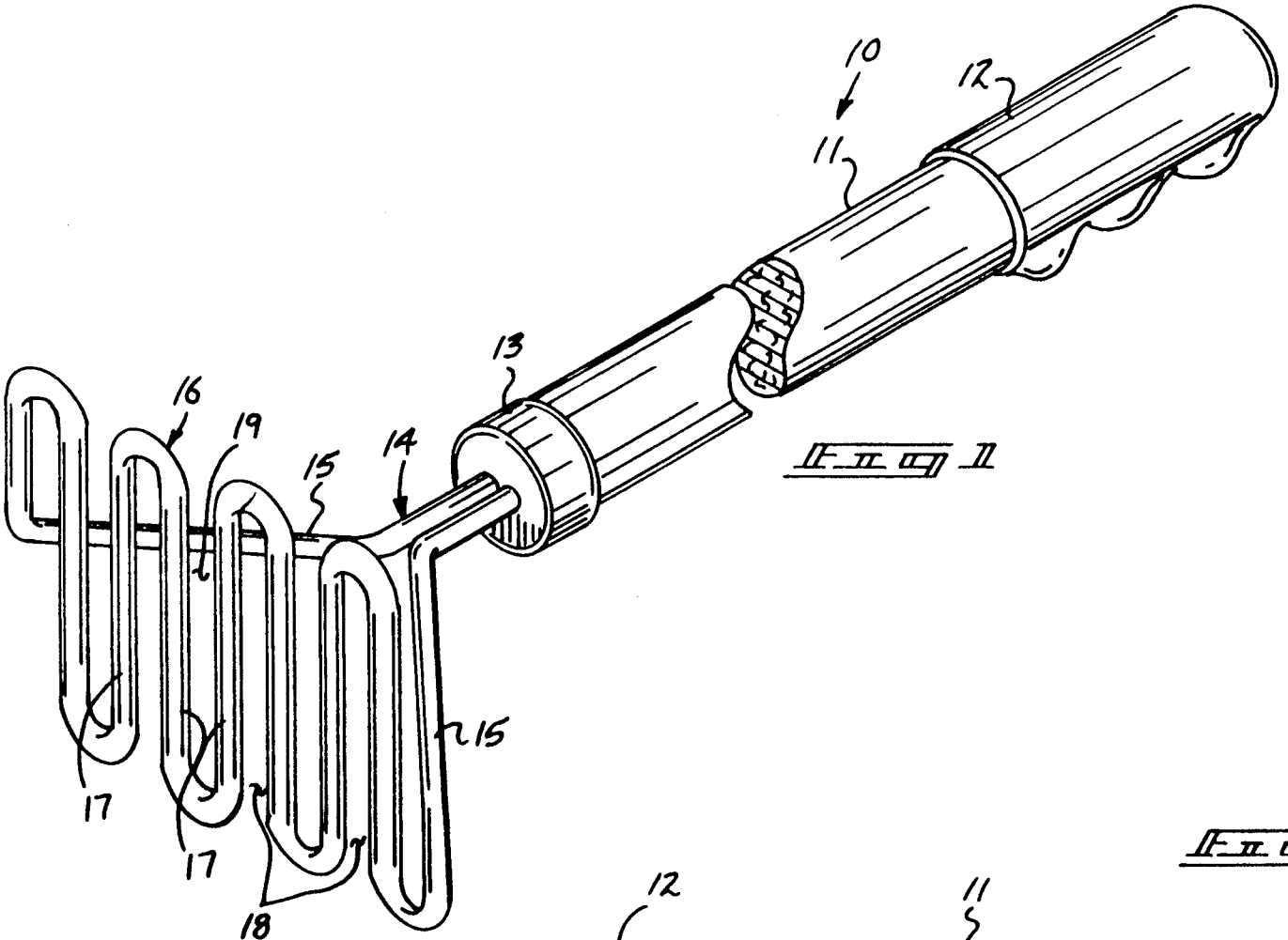
FIG. 1 is an isometric illustration of the instant invention.
Figure 2:
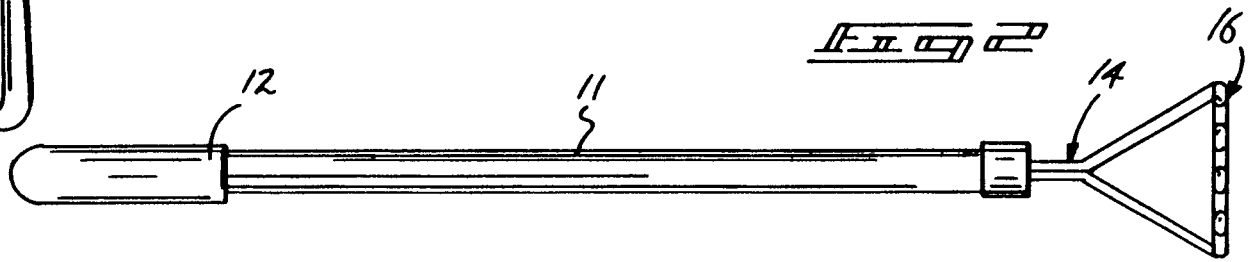
FIG. 2 is an orthographic top view of the invention.

With reference now to the drawings, and in particular to FIGS. 1 to 8 thereof, a new and improved stirring device embodying the principles and concepts of the present invention and generally designated by the reference numerals 10 and 10*a* will be described.

More specifically, the stirring device 10 of the instant invention essentially comprises an elongate handle rod 11 coaxially aligned, including a handle sleeve 12 mounted fixedly to a rear terminal end thereof, wherein the handle sleeve 12 includes finger projections and recesses to enhance grasping of the handle sleeve of an associated handle rod 11. A cylindrical mounting cap 13 is fixedly mounted to a forward terminal end of the handle rod 11. A "Y" shaped support bracket 14 is oriented parallel relative to the axis defined by the mounting cap 13, including diversion bracket legs 15 mounting a serpentine stirring member 16 formed of a continuous rod and including a plurality of parallel interconnected rod members 17 defining respective lower and upper "U" shaped recesses 18 and 19 respectively. The rod members 17 are defined in a coplanar relationship, wherein the coplanar relationship is oriented orthogonally relative to an axis defined by the cylindrical mounting cap 13.

FIG. 3 illustrates the use of a modified stirring device 10*a*, wherein a flexible handle tube 20 is provided defined by a tube cavity 21 of a predetermined length and of a first diameter. A stiffening rod 22 defined by a length equal to the predetermined length and of a second diameter less than the first diameter is receivable within the tube cavity 21. The mounting cap 13 includes an internally threaded socket coaxially aligned relative to the mounting cap 13 to threadedly receive a stiffening rod forward threaded end 24 therewithin. A stiffening rod end cap 23 defined by a third diameter greater than the first diameter is arranged to effect a butting relationship of a rear terminal end the handle tube 20.

Figure 8:
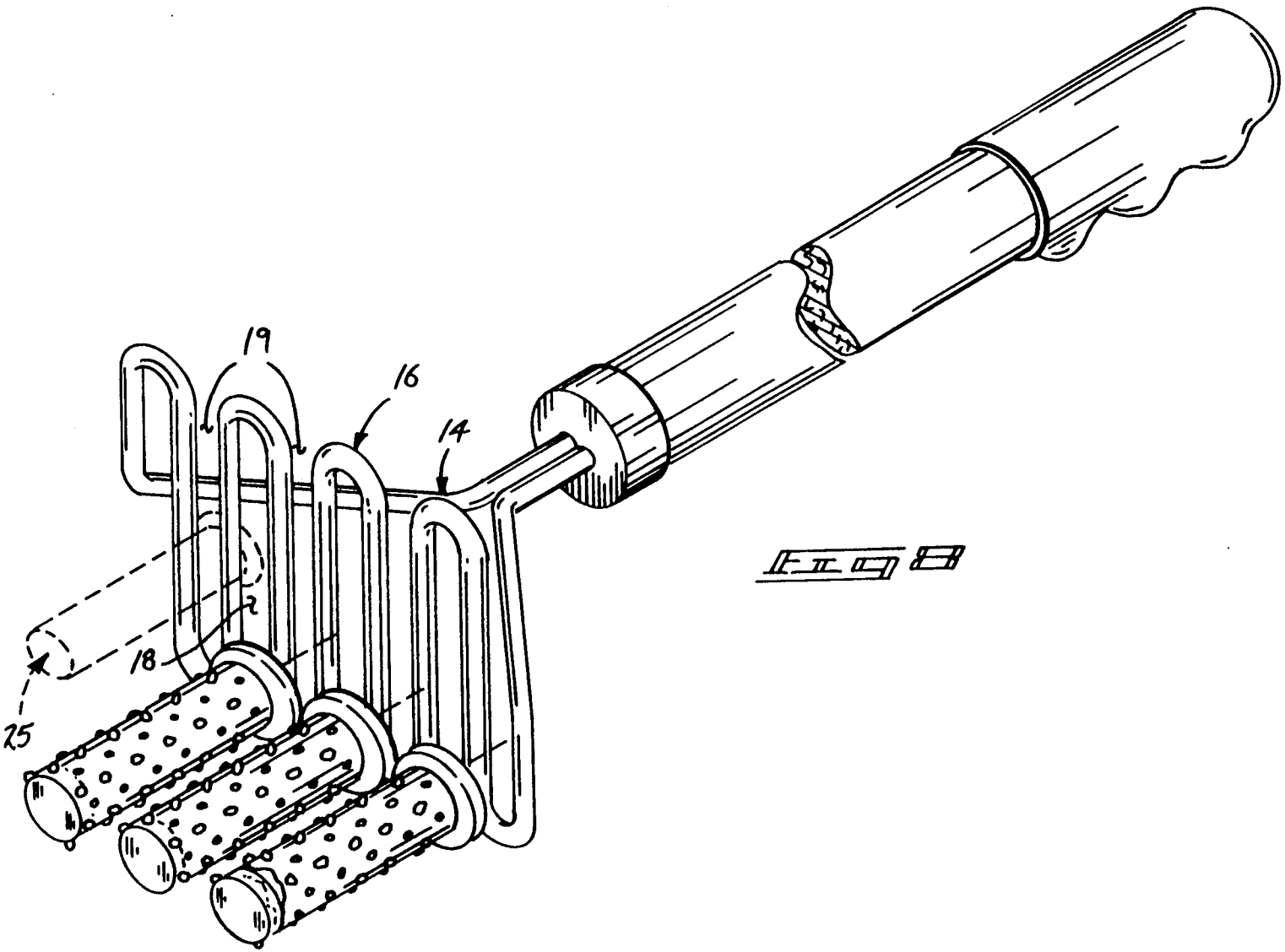
FIG. 8 is an isometric illustration of the stirring device in conjunction with the agitating tubes for association therewith.

Further, agitating tubes 25, as illustrated in FIG. 8 for example, may be utilized with the device, as exemplified in FIGS. 1 and 3. The agitating tubes 25 are each formed with a cylindrical wall defining a matrix of externally projecting projections 26 and a matrix of bores 27 radially directed within the tube 25. The tube 25 further includes an end web 28 to provide an agitating tube cavity to receive a soap tablet 32 therewithin. The agitating tube 25 includes an entrance opening 29, with an entrance opening flange 30 projecting radially and exteriorly of the tube for securement of the tube within one of the lower or upper recesses 18 or 19, in a manner as illustrated in FIG. 8. In use of the organization, including the agitating tubes 25, stirring of the device effects intermixing of soap tablet 32 within the cavity 31, with a fluid such as water, wherein the soap mixture thusly formed is projected exteriorly of the tube through the associated bores 27, wherein the projections 26 enhance in the agitation and cleaning of a garment.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stirring device for use in washing of garments, comprising, an elongate handle, the elongate handle including a cylindrical mounting cap fixedly mounted to a forward terminal end of the handle, wherein the cylindrical mounting cap fixedly and orthogonally mounts a "Y" shaped support bracket to the mounting cap, wherein the cylindrical mounting cap defines a cap axis, and the "Y" shaped support bracket is oriented parallel relative to the cap axis and extending longitudinally thereof, and the "Y" shaped support bracket includes a plurality of diverging bracket legs, and a serpentine stirring member is mounted fixedly and between the diverging bracket legs, and is formed of a continuous rod defined by parallel interconnected rod members, the rod members define alternating "U" shaped upper and lower recesses arranged in a coplanar relationship with each other and the rod members, and wherein the handle is formed of a flexible handle tube, the handle tube including a tube cavity defined by a predetermined length and a first diameter, and a stiffening rod selectively positionable within the tube cavity, the stiffening rod formed of a rigid material and defined by a second diameter less than the first diameter, and of a length equal to the predetermined length for complementary reception with the tube cavity, and wherein the mounting cap includes an internally threaded socket coaxially aligned with the mounting cap and in confrontation to the tube cavity, and the stiffening rod includes a rod forward threaded end receivable within the threaded socket of the mounting cap, and the rod including a stiffening rod end cap defined by a third diameter greater than the first diameter fixedly and orthogonally mounted to a rear terminal end of the stiffening rod to define an abutment surface for a rear terminal end of the tube, and including a plurality of agitating tubes receivable within the "U" shaped upper and lower recesses.

2. A stirring device as set forth in claim 1 wherein each of the agitating tubes includes cylindrical side wall, including a matrix or projections and a matrix of bores directed radially through the agitating tube, and the agitating tube includes an end web defining an agitating tube cavity with an entrance opening formed into the agitating tube remote from the end web wherein the entrance is coaxially aligned with the end web, and the entrance opening receives a soap tablet for projection within the agitating tube cavity, and the agitating tube includes an entrance opening flange projecting radially and exteriorly of the agitating tube at the entrance opening for enhanced securement of the agitating tube within the stirring member between a plurality of adjacent rod members.

* * * * *